United States Patent [19]

Hart

[11] Patent Number: 4,789,012

[45] Date of Patent: Dec. 6, 1988

[54] INJECTION HEAD FOR FILLING DISPENSER THAT METERS PROPORTIONATE INCREMENTS OF DISSIMILAR MATERIALS

[75] Inventor: Duane H. Hart, St. Paul, Minn.

[73] Assignee: Minnesota Mining and Manufacturing Company, St. Paul, Minn.

[21] Appl. No.: 29,431

[22] Filed: Mar. 23, 1987

[51] Int. Cl.[4] ..... B65B 3/04

[52] U.S. Cl. ..... 141/18; 141/392

[58] Field of Search ..... 141/1–12, 141/100–110, 234–248, 325, 326, 327, 392, 18, 21–29; 222/485, 484

[56] References Cited

U.S. PATENT DOCUMENTS

| | | | |
|---|---|---|---|
| 1,676,734 | 7/1928 | Hopkins | 141/9 |
| 1,828,865 | 10/1931 | Hopkins | 141/9 |
| 2,905,364 | 9/1959 | Marraffino | 222/485 X |
| 4,098,435 | 7/1978 | Weyn | 222/94 |
| 4,211,341 | 7/1980 | Weyn | 222/94 |

FOREIGN PATENT DOCUMENTS

| | | | |
|---|---|---|---|
| 822367 | 7/1949 | Fed. Rep. of Germany | 141/325 |

OTHER PUBLICATIONS

*Happi*, p. 74 (Jun. 1986).

"Thiele Speed Nozzle", a brochure of the Thiele Engineering Co., Minneapolis, MN.

*Primary Examiner*—Henry J. Recla

*Assistant Examiner*—Ernest G. Cusick

*Attorney, Agent, or Firm*—Donald M. Sell; James V. Lilly

[57] ABSTRACT

An injection head for filling a tubular dispenser with dissimilar materials. The injection head is divided into two or more compartments, and the outlet of each compartment is a set of contiguous honeycomb cells.

7 Claims, 2 Drawing Sheets

INJECTION HEAD FOR FILLING DISPENSER THAT METERS PROPORTIONATE INCREMENTS OF DISSIMILAR MATERIALS

BACKGROUND OF THE INVENTION

1. Field of the Invention

The invention concerns an apparatus for filling a dispenser that simultaneously meters proportionate increments of dissimilar materials while storing unused portions in the dispenser for later use.

2. Description of Related Art

Reliable and inexpensive dispensers are known which simultaneously meter proportionate increments of dissimilar materials. For example, U.S. Pat. Nos. 4,098,435 and 4,221,341 (Weyn '435 and Weyn '341) describe dispensers for multiple-part dentifrices that are more efficacious if kept apart until they are used. A dispenser available from Calmar Dispensing Systems, Inc., Watchung, N.J., as the "Realex HVD" dispenser has recently been used for dispensing "Aqua-Fresh" striped toothpaste, as shown in HAPPI, p. 74 (June, 1986).

An injection head for filling containers with a single material is shown in "Thiele Speed Nozzle", a brochure of the Thiele Engineering Company, Minneapolis, Minn.

SUMMARY OF THE INVENTION

It is difficult to fill a single-cavity dispenser with dissimilar materials without causing intermixing of the materials during the fill operation. This is particularly so when the materials polymerize if mixed together. The present invention provides an injection head for filling a dispenser that has a tubular cavity of substantially uniform cross section and the capability simultaneously to dispense increments of dissimilar extrudable materials. The injection head fits loosely into the tubular cavity and includes at its outlet end a honeycomb formed with a plurality of axial channels of substantially equal size, said honeycomb being divided into two or more sets of said channels, and means for simultaneously injecting two or more extrudable materials into separate sets of said channels.

DETAILED DESCRIPTION OF THE PREFERRED EMBODIMENT

Figure 1:
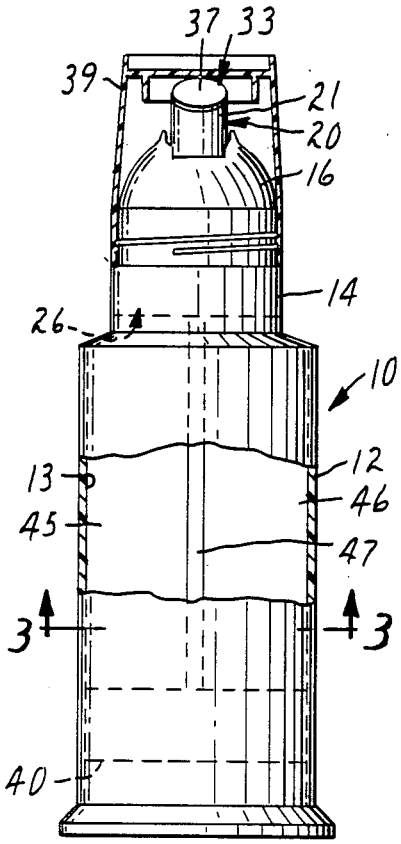
FIG. 1 is a front elevation, partly cut away to a central section, of a preferred dispenser that can be filled with three dissimilar materials using the injection head of the invention.
Figure 2:
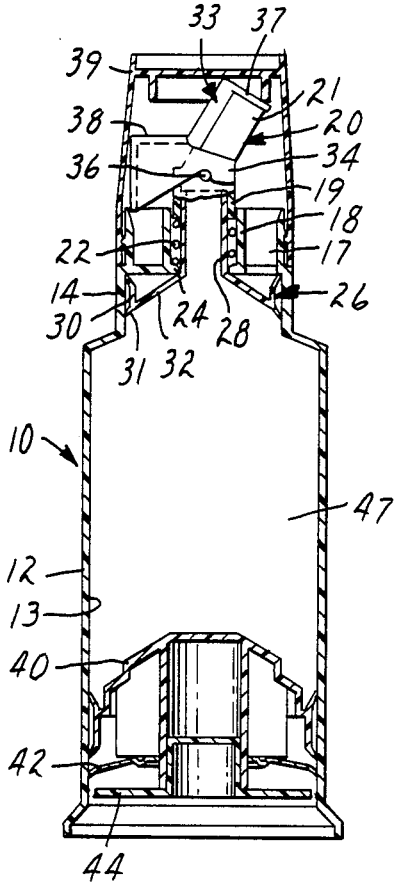
FIG. 2 is a side elevation of the dispenser of FIG. 1, fully cut away to a central section.
Figure 3:
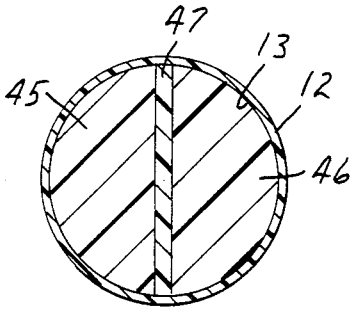
FIG. 3 is a cross section along line 3—3 of FIG. 1.

The dispenser 10 shown in FIGS. 1–3 has a molded plastic body 12, which over most of its length contains an unobstructed cylindrical cavity 13 of uniform cross section. At one end, the plastic body is formed with a cylindrical collar 14 and a partial dome 16. Webs 17 project from the internal surface of the dome 16 to support a cylindrical central neck 18. Slidably positioned within the central neck 18 is the large-diameter inlet end 19 of a nozzle 20 which also has a small-diameter outlet end 21. The large-diameter end rests against a coil spring 22 that is seated on an annular flange 24 at the end of the central neck 18 adjacent the cavity 13. A piston 26 is slidably positioned within the collar 14 and is formed with a hollow cylindrical projection 28 which fits tightly in the large-diameter end 19 of the nozzle 20. The piston wall 30 that rides against the wall of the collar 14 is slightly concave and has knife-like edges 31 in order to provide an air-tight seal. The piston surface 32 that faces the cavity 13 is substantially conical.

A lever 33 is formed with two arms 34, each having an indentation fitting over a knob 36 projecting from the large-diameter end 19 of the nozzle 20. The lever also is formed with a cap 37 which covers the outlet 21 of the nozzle 20. When a user depresses the knurled surface 38 of the lever 33, the applied pressure forces the piston 26 downwardly and simultaneously pivots the lever 33 to retract the cap 37 from the nozzle 20. When the lever is released, the coil spring 22 returns the lever 33 and its cap 37 to the position shown in FIGS. 1 and 2. An overcap 39 covers the top of the dispenser 10.

A plunger 40 is slidably positioned at the open end of the cavity 13 and is prevented from moving outwardly by a metal sunburst spring 42, the legs of which bite into the sides of the plastic body 12 to prevent the plunger 40 from moving toward the open end of the cavity. The body-contacting wall of the plunger is shaped like the piston wall 30, thus also providing an air-tight seal. A shield 44 fixed to the plunger extends substantially across the open end of the cavity 13, while leaving a small space through which air can enter or escape.

The cavity 13 has been filled with two extrudable materials 45 and 46 that polymerize when mixed together, each extending over the length of the cavity and through the extrusion outlet provided by the piston projection 28 and the nozzle 20. An extrudable barrier layer 47 extends in separating relationship between polymerizable materials 45 and 46 over their full length.

When a user depresses the knurled surface 38 of the lever 33, the piston 26 is forced away from the extrusion outlet and against the extrudable materials 45, 46 and 47. Because the sunburst spring 42 prevents the plunger 40 from moving outwardly, the extrudable materials are forced through the nozzle 20. When the lever is released, the coil spring 22 returns the cap 37 to its original position shown in FIGS. 1 and 2, and in doing so, the cap cuts off the materials being extruded from the container 10. The coil spring 22 also returns the piston 26 to its original position, thus causing the plunger 40 to move in the same direction by virtue of the air-tight seals provided by the walls of the piston and plunger.

Figure 4:
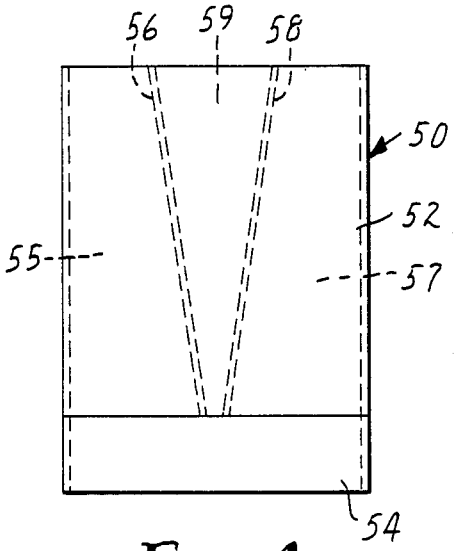
FIG. 4 is a side elevation of an injection head useful for filling the tubular cavity of the dispenser illustrated in FIGS. 1–3.
Figure 5:
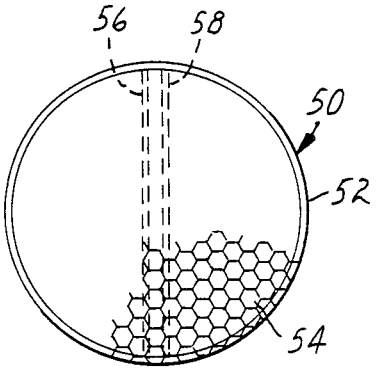
FIG. 5 is an end view of the injection head of FIG. 4.

An injection head 50 useful for filling the tubular cavity 13 of the dispenser 10 is illustrated in FIGS. 4–5. The injection head has a cylindrical tube 52 which fits loosely within the cavity 13. In one end of the cylindrical tube is sealed a honeycomb 54 formed with numerous axial channels of substantially equal size. Preferably the honeycomb channels have a diameter of about 0.5 to 5 mm, with smaller diameters being preferred for extrudable materials of low viscosity. Excellent results have been achieved when each channel of the honeycomb was about 3 mm in diameter and the individual honeycomb sheets had a thickness of about 0.06 mm.

The aluminum honeycomb in the injection head can be in various forms or shapes, such as coplanar corrugated sheets or as spirally-wound alternating flat and corrugated sheets with colinear channels or cells (such as "Spiralgrid" honeycomb, commercially available from the Bloomingdale Products division of American Cyanamid Company —see their bulletin entitled "Aluminum Honeycomb Core Products"). The individual honeycomb channels may be, for example, hexagonal, triangular, rectangular, or sinusoidal in cross-section. Honeycomb having preferred channel sizes and sheet thicknesses is commercially available in the form of coplanar corrugated sheets with hexagonal channels (see, e.g., Hexcel Corp. bulletin DS 2100, dated Mar. 15, 1977).

Sealed to the honeycomb and to the internal surface of the cylindrical tube 52 are two thin walls 56 and 58 which are flat and subdivide the hollow of the cylindrical tube into (1) a first compartment 55 including a first contiguous set of said honeycomb channels, (2) a second compartment 57 including a second contiguous set of said honeycomb channels, and (3) a third central compartment 59 including a third contiguous set of said honeycomb channels, the third set being only one channel in width. Each of the first, second and third compartments is connected (using appropriate tubular conduits and connectors) to a supply of extrudable material under pressure. Flow of the extrudable materials into the compartments is controlled using a suitable valve, pressure control or other conventional fluid handling means to enable simultaneous injection of the polymerizable materials into the compartments.

The walls 56 and 58 of the injection head are canted so that all three compartments are of substantially equal volume. This serves to equalize back pressure when the extrudable materials 45, 46 and 47 are extruded through the honeycomb 54 to fill the dispenser 10.

The injection head 50 promotes a laminar flow of the extrudable materials, thus discouraging any substantial intermixing during the filling operation. The honeycomb 54 also permits a filled dispenser to be removed from the injection head 50 and the filling of the next dispenser commenced without any intervening cleanup. Clean breakaway between fill cycles may be enhanced by injecting a puff of air or other gas at the injection head outlet, by momentarily reversing the fill pumps, by momentarily vibrating the injection head (e.g., using a piezoelectric transducer) or by employing one or more wiping blades that traverse the outlet of the injection head.

The injection head shown in the drawing is divided into three contiguous sets of honeycomb channels. If desired, the injection head can be divided into only two contiguous sets of honeycomb channels, or into four or more contiguous sets. Also, although the honeycomb preferably is divided into sets of channels using one or more planar walls between such sets, nonplanar walls can be used if desired.

Figure 6:
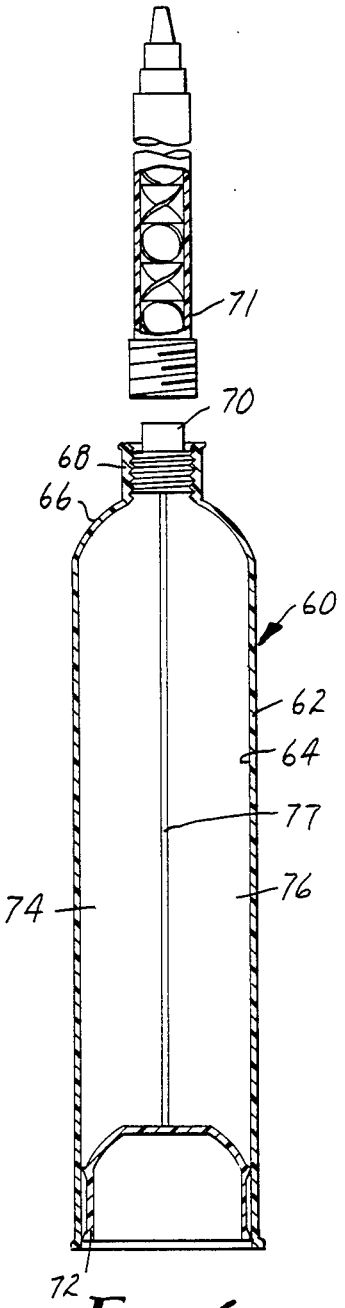
FIG. 6 is a cross section through a second dispenser that can be filled with three dissimilar materials using the injection head of the invention.

The injection head of the invention can be used to fill other dispensers, such as the dispenser 60 shown in FIG. 6. This dispenser is designed for use in a conventional caulking gun (not shown). The dispenser 60 has a molded plastic body 62 which contains an unobstructed cylindrical cavity 64 of uniform cross section that terminates in a dome 66 and a collar 68. The collar is internally threaded or otherwise equipped to receive either a plug 70 or a conventional static mixing nozzle 71. Into the open end of the cavity 64 is fitted a piston 72, the wall of which is shaped like the piston wall 30 of dispenser 10 to provide an air-tight seal. The cavity 64 has been filled with two extrudable materials 74 and 76 that polymerize when mixed together and an extrudable barrier layer 77 that is situated between polymerizable materials 74 and 76 and extends throughout the length of the cavity and the extrusion outlet provided by the collar 68. The backside of the piston 72 is shaped to receive the standard driving element of a conventional caulking gun in order to be driven from the open end of the cavity toward the extrusion outlet and extrude the materials 74, 76 and 77 through the collar 68. Between uses, the filled static mixing nozzle 71 can be left attached to the dispenser 60, to be thrown away and replaced with a new (empty) static mixing nozzle at the time of the next use. Alternatively, the plug 70 can be reinserted in the outlet of the dispenser 60. Because a threaded plug would tend to stir the polymerizable materials adjacent its inner face, it is preferred to use an unthreaded sliding plug that is keyed or labeled to provide the same orientation each time it is reinserted.

In the dispensers illustrated in the drawing, two extrudable materials are separately disposed in semicircular regions within the dispenser, separated by an extrudable planar barrier. The injection head of the invention is not limited to use with three extrudable materials. By using a suitable number of dividing walls, the injection head can be used to fill a dispenser with only two extrudable materials, or with four or more extrudable materials. The extrudable materials can each be disposed in more than one region, with an extrudable barrier layer between adjacent polymerizable materials or regions of polymerizable materials. More than one barrier layer material can be used if desired. Two or more extrudable materials can be separated coaxially by one or more extrudable cylindrical barrier layers. Preferably, the barrier layer or layers lie substantially in a plane that intersects the sidewall of the tubular cavity. The injection head and tubular cavity preferably are circular in cross-section, but if desired can have other shapes (e.g., rectangular, square or oval).

Expressed on a numerical basis, the viscosities of each of the exrudable materials at the desired dispensing temperature and shear rate preferably differ from one another by no more than about 20 percent, more preferably about 10 percent. Preferably the densities of each of the extrudable materials are sufficiently similar at all temperatures to which the dispenser will be exposed during shipment and storage, so that the contents of the dispenser behave substantially like a single fluid and thus stay in position when jostled. Expressed on a numerical basis, their densities preferably do not differ by more than about 5 percent, more preferably about 1 percent.

For utmost convenience of use, the contents of the dispenser should be formulated to be dispensed at ordinary room temperature. However, by heating the contents of the dispenser each time it is used, the contents can be of very high viscosity at ordinary room temperatures. This also tends to enhance long-term storage stability of each of the extrudable materials.

Whether or not the contents of the dispenser are to be dispensed incrementally at room temperature, each of the extrudable materials preferably is formulated to have a sufficiently high yield point at the anticipated storage temperature so that none of the materials is displaced due to gravity or forces encountered in shipping or handling. Thus, it is preferred to blend one or more thixotropic agents with each of the extrudable materials so that the contents of the dispenser tend to stay in the position in which they have been loaded into the dispenser, while also affording low resistance to being dispensed.

Extrudable materials that can be packaged in the dispenser include thermosetting resins such as epoxy resins, urethane resins and silicone resins, together with their associated curing agents, and miscible materials such as dentifrices. After mixing, the resulting mixed extrudates can be put to a variety of uses. For example, thermosetting resins can be used as adhesives, sealants and molding compounds.

The barrier layer can be made using many of the materials described in U.S. Pat. No. 2,982,396 (Shihadeh), Belgian Pat. No. 646,446 (Belgian), U.S. Pat. No. 3,462,008 (Tibbs '008) and U.S. Pat. No. 3,519,250 (Tibbs '250), adjusted however to provide a better rheology match than is shown in those references. When an epoxy resin and curing agent are used as the extrudable materials, then polybutenes, hydrogenated rosin esters, terpene phenolic resins and alpha-pinene resins are preferred barrier layer materials. They can be used alone or in admixture with diluents such as butyl benzyl phthalate or mineral oil. Polybutenes are a particularly preferred material for the barrier layer. Polybutenes have been found to provide especially good storage stability when used with fast curing epoxies. Polybutenes are available commercially over a large range of viscosities and, by selecting one of these and blending it with a thixotropic agent, the rheology of the barrier layer can be readily matched to the rheologies of the polymerizable materials. The rheology of the polybutene can also be adjusted, if desired, by blending two or more polybutenes of appropriate viscosities or by adding a suitable nonreactive organic fluid such as mineral oil. This makes it possible to use polybutenes with a wide variety of polymerizable materials.

Each of the extrudable materials can include surfactants, wetting aids, pigments, inorganic or organic extending or reinforcing fillers, solvents, diluents, and other conventional adjuvants. If fillers are employed, it has been found to be desirable to employ substantially similar volume percentages of filler in each of the extrudable materials as this aids in matching their rheologies.

In the following examples, all parts are by weight. Viscosities reported in the examples were measured at 25° C. with a model DMK 500 Haake viscometer equipped with a "PK-I" 0.3° cone, rotated at 4 rpm unless otherwise noted.

EXAMPLE 1

| | Parts |
|---|---|
| Curing agent (Component A), viscosity 16,636 cps; density 1.142 g/cm$^3$: | |
| Polymercaptan resin ("Capcure" 3-800, Diamond Shamrock) | 1733.1 |
| Tris(2,4,6-dimethylaminomethyl)phenol ("DMP-30", Rohm & Haas) | 192.8 |
| Fumed silica ("Cab-O-Sil" TS-720, Cabot) | 34.3 |
| Base (Component B), viscosity 16,220 cps; density 1.139 g/cm$^3$: | |
| Epoxy resin ("Epon" 828, Shell Chemical) | 898.8 |
| Epoxy resin, 2000–2500 cps @ 25° C. ("Eponex" DRH 151.1, Shell Chemical) | 894.5 |
| Epoxy resin, melting point 70–80° C. ("Epon" 1001F, Shell Chemical) | 127.75 |
| Fumed silica | 39.2 |
| Barrier (Component C), viscosity 19,029 cps; density 1.144 g/cm$^3$: | |
| Polybutene synthetic rubber ("Indopol" H-300, Amoco Chemical) | 46.2 |
| Mineral oil (21 USP white mineral oil, Amoco Chemical) | 19.75 |
| Carbon black ("Regal" 300R, Cabot) | 0.02 |
| Calcium carbonate ("Gama-Sperse" CS-11, Georgia Marble) | 33.03 |
| Fumed silica | 1.0 |

Components A and C were each stirred slowly by hand and then stirred with a motorized stirrer operated at about 3000 rpm for 3 minutes, followed by degassing under >25 mm Hg vacuum. Component B was prepared by mixing one of the liquid epoxy resins ("Eponex" DRH 151.1) with the solid epoxy resin at a temperature of about 110° C. When a uniform mixture had been obtained, the heat was removed and the remaining ingredients were added, the mixture was stirred 5 minutes at about 3000 rpm, and degassed under >25 mm Hg vacuum.

Overlap shear specimens were prepared using as the adhesives equal weights of Components A and B and various amounts of Component C, as indicated below, on FPL-Etched 2024-T3 "Alclad" aluminum panels 1.6 mm in thickness, 2.54 cm in width, overlapped 1.27 cm and assembled using 0.152 mm wire spacers in the bondline. Three test specimens were prepared for each adhesive. The specimens were cured about 16 hrs at 22° C., followed by 2 hours at 71° C. The shear strength was evaluated using a tensile tester operated at a crosshead speed of 2.5 mm/minute. Set out below are overlap shear strength values and the measured standard deviation for adhesives containing varying volume amounts of barrier layer.

| Vol. % Barrier | 0 | 5 | 10 | 15 | 20 | 25 | 30 | 35 |
|---|---|---|---|---|---|---|---|---|
| Overlap shear strength, psi: | 3722 | 3627 | 3691 | 3323 | 3061 | 2287 | 1918 | 1661 |
| Standard deviation, psi: | 216 | 275 | 166 | 338 | 90 | 141 | 113 | 8 |
| Overlap shear strength, MPa: | 25.6 | 25.0 | 25.4 | 22.9 | 21.1 | 15.8 | 13.2 | 11.4 |
| Std. deviation, MPa: | 1.49 | 1.89 | 1.14 | 2.33 | 0.62 | 0.97 | 0.78 | 0.06 |

The above data indicates that at up to about 15 volume % barrier layer, polybutene does not substantially reduce overlap shear strength on aluminum panels.

The injection head 50 of FIGS. 4–5 was prepared by potting a 13 mm thick by 50 mm diameter aluminum honeycomb hexagon (3.2 mm core, 0.06 mm wall thickness) in a 51 mm diameter cylindrical mold, using a two-part epoxy ("EC-1838 B/A", 3M) as the potting compound. The resulting cylinder had a hexagonal honeycomb insert in which the six vertices of the hexagon just touched the wall of the cylinder. The cylinder was cemented to one end of a 90 mm long by 50 mm diameter aluminum tube using two-part epoxy. Two pieces of 1 mm thick 2024-T3 aluminum were cut to form two canted walls that could be inserted in the aluminum tube to form three compartments of approximately equal volumes. The walls were cemented into place using two-part epoxy. At its narrow outlet, the center compartment was 1 honeycomb cell wide by 16 honeycomb cells long. At their semicircular outlets, the two flanking compartments each contained 78 honeycomb cells.

The opposite end of the tube was closed off by casting a disk (about 25 mm thick) of two part epoxy in the end of the tube. The disk was then drilled to accept a 6 mm I.D. aluminum tube in each compartment. These tubes were cemented into place using two-part epoxy, then bonded to 6 mm diameter polyethylene tubing ("Poly-Flo", Imperial Eastman) using cyanoacrylate adhesive ("CA-40 H.V.", 3M). The free ends of the polyethylene tubes were fastened using compression fittings to a hand-powered triaxial dispensing syringe. The barrels of the dispensing syringe were separately filled with Components A, B and C.

Using the injection head assembly, several size "D6L" Calmar Realex HVD dispensers (illustrated in FIGS. 1-3 of the drawing) were filled with equal amounts of Components A and B separated by 5 volume % of Component C as the barrier layer. Three increments of the contents of one of the dispensers were pumped out and tested for overlap shear strength. An average value of 23.7 MPa, standard deviation 1.75 MPa was obtained. After standing for about one day at room temperature, a slight skin that could be cleared by one stroke of the lever formed across the outlet of the dispenser.

In a comparison run, several dispersers were filled using an injection head prepared without honeycomb channels at the outlet. Very uneven fill patterns were noted, and it was difficult to remove filled dispersers from the injection head and commence filling of an empty dispenser, because uneven amounts of extrudable materials were left on the outlet face of the injection head.

Four additional dispensers were filled with the injection head of the invention, heated for 6 hours at 49° C., placed loose in a 17 cm×13 cm×19 cm cardboard box and then immediately (while warm) subjected at room temperature to 13 Hz, 0.5 G vibration for one hour. After then standing for a few days at room temperature, a small amount of skinned material was removed from each dispenser using two strokes of the lever. Extrudate from the third stroke of each of the four dispensers was mixed and used to make overlap shear specimens. It was observed that the overlap shear value had dropped to 10.8 MPa, standard deviation 1.4 MPa. This reduced overlap shear value was thought to be due to a slight imbalance in the rheologies of the barrier and polymerizable materials. It was noted that at 25° C., the viscosities of Components C and A differed by about 14%, and the viscosities of Components C and B differed by about 17%. Accordingly, a further example (shown below) was prepared in which the components had higher room temperature viscosities and less than 8% room temperature viscosity mismatch.

| | Parts |
|---|---|
| Curing agent (Component A), viscosity 20,171 cps; density 1.186 g/cm$^3$: | |
| Polymercaptan resin ("Capcure" 3-800) | 88.2 |

-continued

| | Parts |
|---|---|
| Tris(2,4,5-dimethylaminomethyl)phenol | 9.8 |
| Fumed silica | 2.0 |
| Calcium carbonate | 7.49 |
| Base (Component B), viscosity 19,755 cps; density 1.179 g/cm$^3$: | |
| Epoxy resin ("Epon" 828) | 97 |
| Fumed silica | 3 |
| Barrier (Component C), viscosity 18,716 cps; density 1.181 g/cm$^3$: | |
| Polybutene synthetic rubber | 221.5 |
| Mineral oil | 107.4 |
| Fumed silica | 10.0 |
| Carbon black | 0.1 |
| Calcium carbonate | 191.85 |

Components A, B and C were prepared and loaded into dispensers as in Example 1 except that a smaller injection head and dispensers were employed (injection head 3.6 cm diameter rather than 5 cm; dispensers size "D6S" rather than size D6L, diameter 3.6 cm rather than 5 cm, volume 91 cm$^3$ rather than 159 cm$^3$). It was felt that the use of a smaller diameter dispenser would improve vibration resistance. Each dispenser was then placed in an oven for 7 hours at 49° C., then immediately subjected to the vibration test outlined in ASTM D999-81, Method B. This is believed to be a more severe vibration test than that employed in EXAMPLE 1.

One package containing four of the filled dispensers was tested with the dispensers standing upright, and another package was tested with the dispensers. horizontal. Each package exhibited three peak resonant frequencies (as evaluated using an accelerometer attached to one dispenser within the package) and accordingly was sequentially subjected to vibration at each of those frequencies for 15 minutes. From each package was then removed the dispenser to which the accelerometer had been attached. After the extrusion outlet had been cleared by two strokes of the lever, about 6 cm$^3$ of the contents were dispensed in 3 strokes, mixed for 45 seconds, and used to make overlap shear specimens as described in EXAMPLE 1 and compared to control specimens made immediately after filling a dispenser. Overlap shear specimens were also made using material dispensed from an identical dispenser that had been held for 48 hours at 49° C. without being vibrated and then allowed to cool to room temperature. The overlap shear strengths (average of three specimens) were:

| | Vibrated sample (upright) | Vibrated sample (horizontal) | Heated sample | Control |
|---|---|---|---|---|
| Overlap shear strength,psi: | 3923 | 3421 | 4487 | 3738 |
| Std. deviation, psi: | 161 | 100 | 153 | 69 |
| Overlap shear strength, MPa: | 27.0 | 23.0 | 30.9 | 25.8 |
| Std. deviation, MPa: | 1.1 | 0.6 | 1.05 | 0.47 |

The above data indicates that the filled dispensers of this example should be especially resistant to vibration and heat encountered in shipping and handling.

Various modifications and alterations of this invention will become apparent to those skilled in the art without departing from the scope and spirit of this invention, and it should be understood that this invention is not limited to the illustrative embodiments set forth herein.

I claim:

1. Apparatus useful for filling a dispenser having a body formed with a tubular cavity of substantially uniform cross section, said apparatus comprising:

an injection head that fits loosely into said tubular cavity and includes at its outlet end a honeycomb formed with a plurality of axial channels of substantially equal size, said honeycomb being divided into two or more sets of said channels.

2. Apparatus as defined in claim 1 wherein said tubular cavity is cylindrical, said injection head comprises a cylindrical hollow tube and said honeycomb fills one end of said tube, and extending from said honeycomb to the other end of said tube and across said tube are a pair of thin walls that subdivide the hollow of said tube into (1) a first compartment including a first contiguous set of said channels, (2) a second compartment including a second contiguous set of said channels, and (3) a third compartment including a third contiguous set of said channels, said walls being canted with respect to the central axis of said cylindrical cavity.

3. Apparatus as defined in claim 2 wherein said first and said second sets of channels are approximately semicircular in cross section, and said third contiguous set of channels lies in separating relationship between said first and said second sets of channels.

4. Apparatus as defined in claim 2 wherein said first, second and third compartments are of substantially equal volume.

5. An injection head useful for filling a tubular cavity of uniform cross section, which cavity is formed in the body of a dispenser, said injection head comprising:

a hollow tube that loosely fits into said tubular cavity, a honeycomb mounted at one end of the hollow of said tube and formed with a plurality of axial channels of substantially equal size, and a pair of walls extending from said honeycomb to the other end of said tube and subdividing the hollow of said tube into (1) a first compartment including a first contiguous set of said channels, (2) a second compartment including a second contiguous set of said channels, and (3) a third compartment including a third contiguous set of said channels which are small in number compared to said first and second sets and lie in separating relationship between said first and second sets, said walls being canted so that said first, second and third compartments are of substantially equal volume.

6. An injection head as defined in claim 5 wherein each of said walls is thin and substantially flat.

7. An injection head as defined in claim 5 wherein said third set of channels is a row of channels of said honeycomb, the length of said row extending across said tube, and the width of said row being about the diameter of a single channel of said honeycomb.

* * * * *